US008303068B2

(12) United States Patent
Ikeda et al.

(10) Patent No.: US 8,303,068 B2
(45) Date of Patent: Nov. 6, 2012

(54) INKJET PRINTER, INKJET PRINTER CONTROLLER AND METHOD FOR CONTROLLING THE INKJET PRINTER

(75) Inventors: Akira Ikeda, Tomi (JP); Shinya Nakano, Tomi (JP); Shinji Nutazawa, Tomi (JP); Kaoru Kodaira, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 956 days.

(21) Appl. No.: 12/117,501

(22) Filed: May 8, 2008

(65) Prior Publication Data

US 2008/0278531 A1 Nov. 13, 2008

(30) Foreign Application Priority Data

May 9, 2007 (JP) ..... 2007-124899

(51) Int. Cl.
*B41J 29/38* (2006.01)

(52) U.S. Cl. ..... 347/14; 347/17

(58) Field of Classification Search ..... 347/12, 347/14, 84, 17

See application file for complete search history.

(56) References Cited

U.S. PATENT DOCUMENTS 5,276,459 A * 1/1994 Danzuka et al. ..... 346/33 A
5,343,231 A * 8/1994 Suzuki ..... 347/14
5,353,052 A * 10/1994 Suzuki et al. ..... 347/19
6,092,939 A * 7/2000 Nishikori et al. ..... 400/61
6,244,688 B1 * 6/2001 Hickman ..... 347/43
6,460,976 B1 * 10/2002 Oikawa ..... 347/57
6,817,692 B2 * 11/2004 Nakazawa et al. ..... 347/12
6,994,413 B2 * 2/2006 Otsuka et al. ..... 347/19
2002/0158936 A1 * 10/2002 Otsuka et al. ..... 347/19
2005/0128229 A1 * 6/2005 Shibata et al. ..... 347/6
2006/0061624 A1 * 3/2006 Nagashima ..... 347/54
2006/0214964 A1 * 9/2006 Mitsuzawa ..... 347/14
2008/0055349 A1 * 3/2008 Yoshida et al. ..... 347/14

FOREIGN PATENT DOCUMENTS

JP 2000-62153 2/2000

* cited by examiner

*Primary Examiner* — Charlie Peng
*Assistant Examiner* — Peter Radkowski
(74) *Attorney, Agent, or Firm* — Ditthavong Mori & Steiner, P.C.

(57) ABSTRACT

An inkjet printer includes a first printer head configured to eject ink to a first printing area on a surface of a print medium to form first ink dots in the first printing area, and a second printer head configured to eject ink to a second printing area on the surface of the print medium to form second ink dots in the second printing area. A detector is configured to detect first and second printing states in the first and second printing areas, respectively. A comparing unit is configured to compare the first and second printing states. An ejection controller is configured to control ejection from the first and second printer heads. A printing state compensator is configured to compensate ejection control performed by the ejection controller according to a comparison result output by the comparing unit so that the first and second printing states are substantially equal.

19 Claims, 6 Drawing Sheets

INKJET PRINTER, INKJET PRINTER CONTROLLER AND METHOD FOR CONTROLLING THE INKJET PRINTER

CROSS-REFERENCE TO RELATED APPLICATIONS

The present application claims priority under 35 U.S.C. §119 to Japanese Patent Application No. 2007-124899, filed May 9, 2007. The contents of this application are incorporated herein by reference in their entirety.

BACKGROUND OF THE INVENTION

1. Field of the Invention

The present invention relates to an inkjet printer, an inkjet printer controller and a method for controlling the inkjet printer.

2. Discussion of the Background

An inkjet printer is an apparatus for printing information such as characters, figures, patterns on a printing surface of a print medium by ejecting microparticles of ink from a printer head while moving the printer head in the anteroposterior direction and the lateral direction relative to the print medium. The printer head has a plurality of nozzles for ejecting ink which are aligned in the anteroposterior direction at a predetermined pitch. While the ink ejection from the respective nozzles is controlled by an ejection controller, ink is ejected from the nozzles with moving a carriage in a lateral direction by a lateral moving mechanism so as to form a band-like printing area of which width, i.e. print width, corresponds to the width in the anteroposterior direction of the nozzle array from a nozzle at the front end to a nozzle at the rear end of the printer head and which extends in the lateral direction. This action is carried out in combination with the relative movement in the anteroposterior direction of the print medium by the anteroposterior moving mechanism, thereby printing desired information on the printing surface.

Recently, there is a market demand for high speed printing, so a multi-head inkjet printer having a plurality of printer heads as mentioned above which are aligned in the anteroposterior direction in a carriage become popular. For example, in a multi-head inkjet printer having four printer heads which are shifted from each other in the anteroposterior direction and the lateral direction so that they are arranged in a zigzag shape, so-called "staggered arrangement", respective nozzle arrays of the four printer heads are configured to be continued in the anteroposterior direction as seen from the side of the carriage so that the printer can print at once four times as wide as a print width of a single printer head from a nozzle at the front end of a printer head held at the front side of the carriage to a nozzle at the rear end of a printer head held at the rear side of the carriage. For example, JP-A-2000-62153 discloses such a printer. The contents of this publication are incorporated herein by reference in their entirety.

Since each of printer heads used in a multi-head inkjet printer shares a band range including printing information which is divided in the anteroposterior direction, printer heads having the same nozzle diameter and array are employed for the multi-head inkjet printer. Further, when printing on a print medium with uniform color density (brightness of color and color saturation), an ejection controller for controlling the ink ejection of the respective printer heads outputs basically the same control signals as ejection control values to the respective heads. However, the ejection characteristics of the respective printer heads are actually slightly different from each other within a predetermined range even after setting predetermined parameters for each head unit so that the uniform color density over the entire print width may not be obtained even when the plurality of printer heads are controlled with ejection signal values for the uniform color density. For example, in the aforementioned multi-head inkjet printer in which four printer heads are arranged in the staggered arrangement, if the color density of a printing area printed by any one of the printer heads is lower (higher) than the color density of a printing area printed by the other printer heads, there will be a phenomenon, called "banding", that contrasting density is striped according to the width of nozzle array of the aforementioned printer head in the entire print width of the four printer heads.

The banding is not preferable because it affects the print quality. If this phenomenon is observed, it is necessary to replace each printer head held by the carriage and then start over the adjustment setting. Accordingly, there are problems of leading to more complexity of production process and taking longer time for the production. There is a possibility that one or more of printer heads is broken or damaged and is thus required to be replaced after delivering an inkjet printer. As the aforementioned phenomenon occurs under the circumstances, there is a problem of decreasing the operation rate of the inkjet printer.

SUMMARY OF THE INVENTION

According to one aspect of the present invention, an inkjet printer includes a first printer head, a second printer head, a carriage, a detector, a comparing unit, an ejection controller and a printing state compensator. The first printer head has a plurality of first nozzles and is configured to eject ink from the plurality of first nozzles to a first printing area on a surface of a print medium to form first ink dots in the first printing area. The second printer head has a plurality of second nozzles and is configured to eject ink from the plurality of second nozzles to a second printing area on the surface of the print medium to form second ink dots in the second printing area. The carriage holds the first and second printer heads and relatively movable along first and second directions with respect to the surface of the print medium. The first and second directions are perpendicular. The detector is configured to detect first and second printing states in the first and second printing areas, respectively. The comparing unit is configured to compare the first and second printing states detected by the detector. The ejection controller is configured to control ejection from the first and second printer heads. The printing state compensator is configured to compensate ejection control performed by the ejection controller according to a comparison result output by the comparing unit so that the first and second printing states are substantially equal.

According to another aspect of the present invention, an inkjet printer controller includes a detector, a comparing unit, an ejection controller and a printing state compensator. The detector is configured to detect first and second printing states in first and second printing areas, respectively. A first printer head ejects ink to the first printing area on a surface of a print medium. A second printer head ejects ink to the second printing area on the surface of the print medium. The comparing unit is configured to compare the first and second printing states detected by the detector. The ejection controller is configured to control ejection from the first and second printer heads. The printing state compensator is configured to compensate ejection control performed by the ejection controller according to a comparison result output by the comparing unit so that the first and second printing states are substantially equal.

According to further aspect of the present invention, a method for controlling an inkjet printer includes ejecting ink from a first printer head to a first printing area on a surface of a print medium, and ejecting ink from a second printer head to a second printing area on the surface of the print medium. First and second printing states in the first and second printing areas are detected, respectively. The first and second printing states are compared. Ejection from the first and second printer heads are controlled. The ejection control in the controlling step is controlled according to a comparison result in the comparing step so that the first and second printing states are substantially equal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
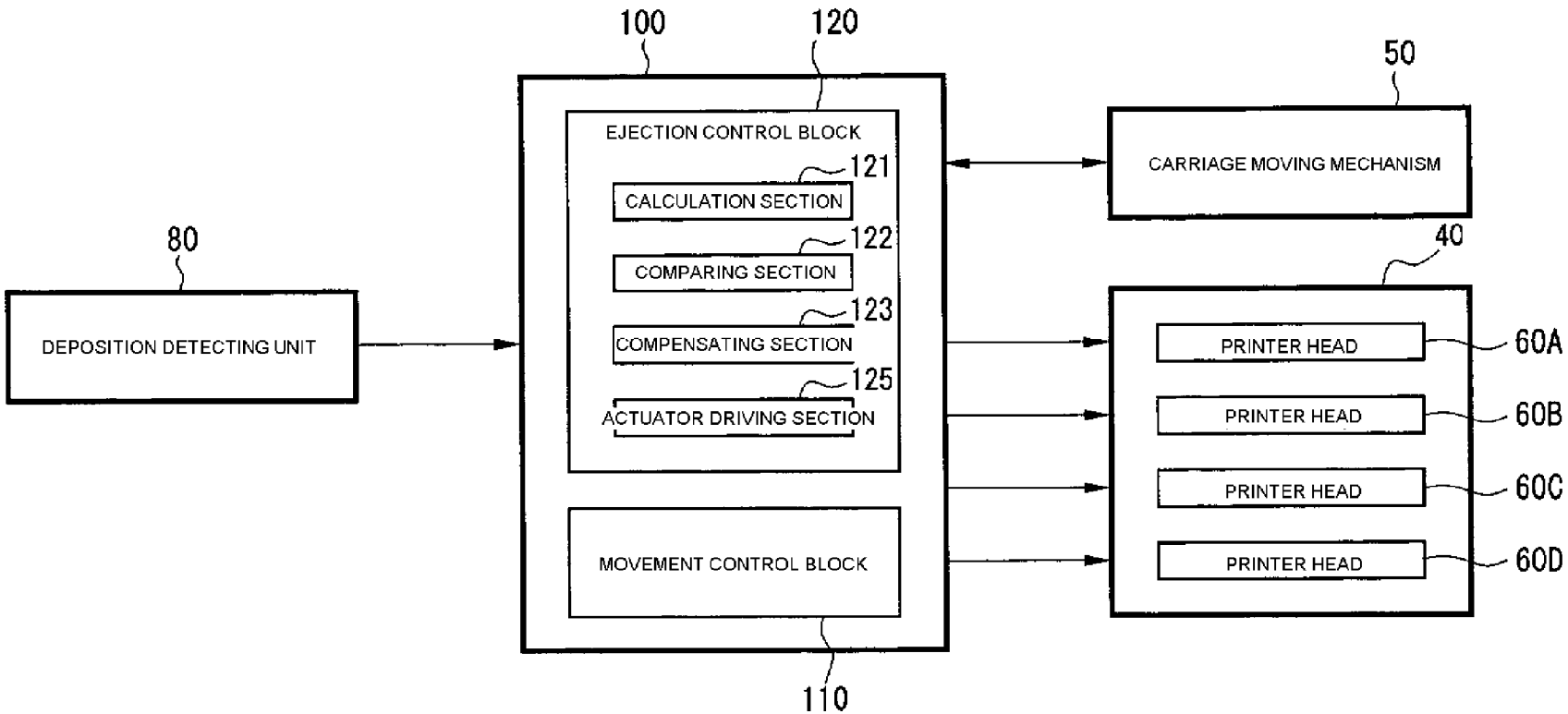
FIG. 1 is a block diagram showing a control structure according to an embodiment of the present invention.

The embodiments will now be described with reference to the accompanying drawings, wherein like reference numerals designate corresponding or identical elements throughout the various drawings.

Referring to FIG. 1, an inkjet printer according to an embodiment of the present invention includes a carriage holding a plurality of printer heads which are aligned in the anteroposterior direction and each of which has a plurality of nozzles for ejecting ink, a medium holding unit (for example, a platen 20 in the embodiment) for holding a print medium, a lateral moving mechanism (for example, a carriage moving mechanism 50 in the embodiment) for moving the carriage in the lateral direction along a printing surface of the print medium held by the medium holding unit, an anteroposterior moving mechanism (for example, a medium moving mechanism 30 in the embodiment) for moving the print medium in the anteroposterior direction relative to the carriage, and an ejection controller (for example, an ejection control block 120 of a control device in the embodiment) for controlling ink ejection from the respective nozzles of the plurality of printer heads. A predetermined printing is conducted on the printing surface of the print medium by combining the action of ejecting ink from nozzles by the ejection controller while moving the carriage in the lateral direction by the lateral moving mechanism with anteroposterior movement of the print medium by the anteroposterior moving mechanism. The control device for the inkjet printer includes a detecting unit (for example, a printing detecting unit 80 in the embodiment) for detecting the printing states of ink deposited on the print medium, a comparing unit (for example, a comparing section 122 in the embodiment) for comparing the printing states detected by the detecting unit, and a compensating unit (for example, a compensating section 123 in the embodiment) for compensating the ejection control value of the ejection controller based on the comparison result of the comparing unit. The ejection controller activates the plurality of printer heads to eject ink according to ejection control values for uniform density to form a plurality of head correspondence printing areas, corresponding to the respective printer heads, on the print medium, the detecting unit detects a printing state of ink in each head correspondence printing area, the comparing unit compares the printing states of the plurality of head correspondence printing areas, and based on the comparison result of the comparing unit, the compensating unit sets a compensation value for the ejection control value to make the printing states by the plurality of printer heads uniform. The terminology "printing state" means, for example, a geometric distribution state of ink deposited on the print medium, for example, the diameter (spot diameter) or the area of ink drop deposited on the print medium, the area density (the area of ink occupying a unit area) of ink in the printing area, or the brightness of the printing area.

As the compensation value, a temperature compensation value based on the temperature of the printer head is preferably used. The temperature compensation value based on the temperature of the printer head is a compensation value for coping with variation in ink drop diameter according to the variation in ambient temperature so as to make ink drops of constant ejection control value uniform. That is, as the ambient temperature of the printer head varies, the diameter of ink drop ejected from the nozzle varies relative to the same ejection control value due to variation in ink viscosity, the nozzle diameter, and the like. The variation of diameter of ink drop directly influences the printing state of ink so that the density of entire print matter differs between summer, that is, higher temperature and winter, that is, lower temperature. For this, inkjet printer has temperature compensation values for changing the diameter of ink drop to absorb the variation in diameter of ink drop according to the variation in ambient temperature. In the present invention, the aforementioned temperature compensation values are used to be adapted to one or some of printer heads as an object to be compensated. Relations between the ambient temperature and the diameter of ink drop ejected from nozzle are previously verified by means of tests or the like and are set and stored in a memory of the ejection controller.

Further, the printing state of ink is preferably the diameter of ink drop deposited on the print medium and also preferably the area density of ink relative to the print medium.

In the inkjet printer according to an embodiment of the present invention, the printer includes a carriage holding a plurality of printer heads which are aligned in the anteroposterior direction and each of which has a plurality of nozzles for ejecting ink; a medium holding unit (for example, a platen 20 in the embodiment) for holding a print medium; a lateral moving mechanism (for example, a carriage moving mechanism 50 in the embodiment) for moving the carriage in the lateral direction along a printing surface of the print medium held by the medium holding unit; an anteroposterior moving mechanism (for example, a medium moving mechanism 30 in the embodiment) for moving the print medium in the anteroposterior direction relative to the carriage; and an ejection controller (for example, an ejection control block 120 of a control device in the embodiment) for controlling ink ejection from the respective nozzles of the plurality of printer heads. A predetermined printing is conducted on the printing surface of the print medium by combining the action of ejecting ink from nozzles by the ejection controller while moving the carriage in the lateral direction by the lateral moving mechanism with anteroposterior movement of the print medium by the anteroposterior moving mechanism. A control method according to an embodiment of the present invention includes ejecting ink according to ejection control values for uniform density from the plurality of printer heads to form a plurality of head correspondence printing areas; detecting a printing state of ink in each head correspondence printing area by a detecting unit (for example, a printing detecting unit 80 in the embodiment) for detecting the printing states of ink deposited on the print medium; comparing the printing states of the plurality of head correspondence printing areas by a comparing unit (for example, a comparing section 122 of the embodiment) for comparing the printing states of ink detected the detecting unit; and setting a compensation value for the ejection control value by a compensating unit (for example, a compensating section 123 of the embodiment) to make the printing states by the plurality of printer heads uniform.

In the printer according to the embodiment of the present invention, the plurality of printer heads are activated to eject ink according to ejection control values for uniform density to form band-like head correspondence printing areas corresponding to the printer heads, respectively. The detecting unit detects the printing states of ink in the respective head correspondence printing areas and the comparing unit compares the printing states of ink in the head correspondence printing areas. Based on the comparison result, a compensation value for the ejection control value is set to make the printing states by the plurality of printer heads uniform. That is, in an inkjet printer with the control device, a test print is conducted with ejection control values for making uniform color density over entire print width originally, the printing states of ink in respective head correspondence printing areas are detected and compared, and a compensation value relative to the ejection control value is automatically set to make the printing states of ink by the printer heads uniform. According to the control device of the present invention, therefore, there is provided a multi-head inkjet printer having a plurality of printer heads which can print with uniform color density over entire print width without complex operation such as replacing a printer head because a compensation value relative to the ejection control value is set for an appropriate printer head even when banding would occur due to a variation in ejection characteristics of the printer heads under conventional circumstances.

According to the aspect using temperature compensation values according to the temperature of the printer head as the aforementioned compensation value, an existing temperature compensation value is adapted to a printer head as the object to be compensated, thereby changing and compensating the diameters of ink drops ejected from nozzles to make the printing state of ink of the respective head correspondence printing areas uniform and thus preventing occurrence of banding by a simple and reasonable system.

According to the aspect of using the diameter of ink deposited on the print medium as the printing state of ink, the diameter (spot diameter) of deposited ink formed by ink drop is used as the detection value, thereby ensuring steady compensation by a simple control system. In addition, in case of applying the aspect of using the aforementioned temperature compensation value as the compensation value, the relation between the diameter of ink drop changed by the temperature compensation values and the spot diameter is a linear relation so that the process is simple, that is, the compensation can be quickly and surely achieved without conducting the test print several times. On the other hand, according to the aspect of using the area density of ink relative to the print medium as the printing state of ink, suitable comparison with little error is ensured even when there are ink dots of which shapes are deformed circles. The area of ink occupying a constant area, that is, the density of a printing area is used as the detection value, thereby easily setting a compensation value capable of compensating the difference in density close to that observed by eyes.

In a control method for a multi-head inkjet printer according to the embodiment of the present invention, the plurality of printer heads are activated to eject ink according to ejection control values for uniform density to form band-like head correspondence printing areas corresponding to the printer heads, respectively. Then, the detecting unit detects the printing states of ink in the respective head correspondence printing areas and the comparing unit compares the printing states of ink in the head correspondence printing areas detected by the detecting unit. The compensating unit sets a compensation value for the ejection control value to make the printing states by the plurality of printer heads uniform. In this control method, a test print is conducted with ejection control values for making uniform color density over entire print width originally, the printing states of ink in respective head correspondence printing areas are detected by the detecting unit and are compared by the comparing unit, and a compensation value relative to the ejection control value is set by the compensating unit to make the printing states of ink by the printer heads uniform. Therefore, in a multi-head inkjet printer having a plurality of printer heads, the control method enables the printer to print with uniform color density over entire print width without complex operation such as replacing a printer head because a compensation value relative to the ejection control value is set for an appropriate printer head even when banding would occur due to a variation in ejection characteristics of the printer heads under the conventional control method.

According to the embodiment of the present invention, therefore, there are provided a control device and a control method for an inkjet printer capable of printing with uniform color density over entire print width by all of a plurality of printer heads without complex operation even when there is a variation in ejection characteristics of the respective printer heads.

Figure 2:
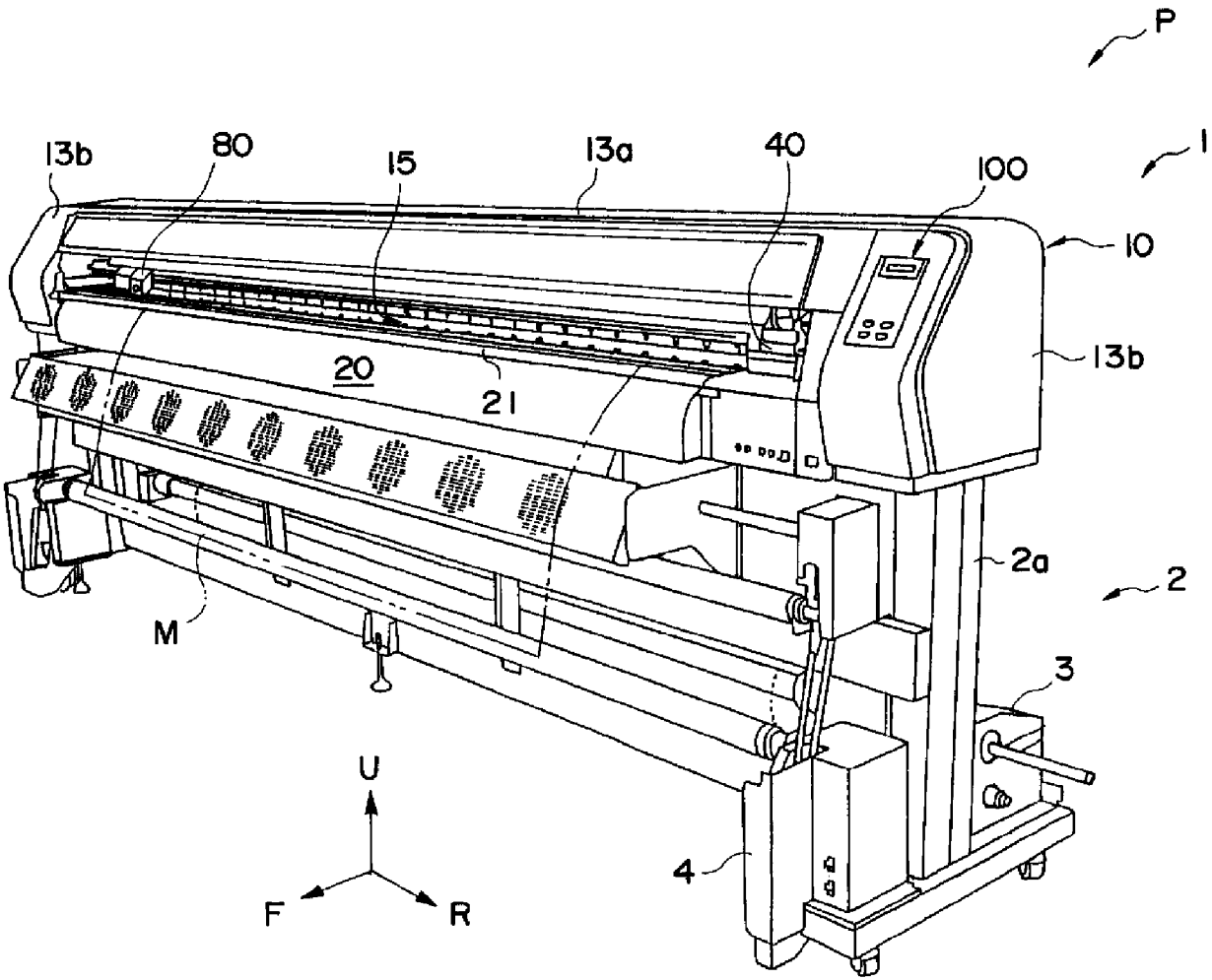
FIG. 2 is a perspective view showing the appearance of a printing apparatus according to the embodiment of the present invention.
Figure 3:
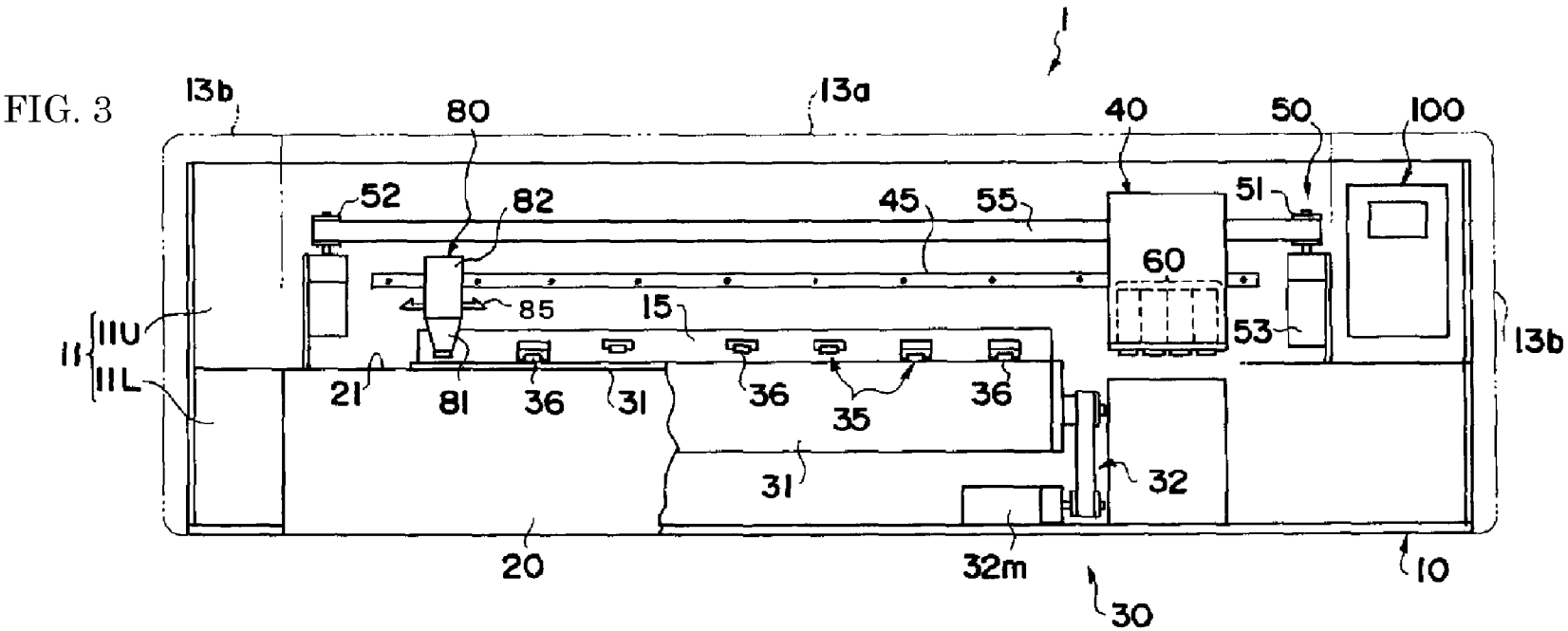
FIG. 3 is a front view showing a schematic structure of a main unit of the printing apparatus.

FIG. 2 is a perspective view showing an inkjet printer (hereinafter, referred to as "printing apparatus") according to an embodiment of the present invention, a printing apparatus P having X-Y axes, i.e. two axes one of which is for movement of a print medium and another of which is for movement of a printer head, taken diagonally from the front. FIG. 3 shows a schematic structure of a main unit of the printing apparatus P. First, the schematic structure of the printing apparatus P will be described with reference to these drawings. It should be noted that the directions of arrows F, R, U marked in FIG. 2 are forward, rightward, upward in the following description, respectively.

The printing apparatus P is an apparatus for conducting a predetermined action such as printing to a sheet-like print medium M called "medium" such as a tarpaulin and a weather-resistant polyvinyl chloride (PVC) sheet and mainly includes a main unit 1 having a shape like a horizontally long rectangular box and a supporting unit 2 for supporting the main unit 1 at a position facilitating the operation. Disposed before and behind right and left legs 2*a* as components of the supporting unit 2 are a feeding mechanism 3 for feeding a unprocessed print medium which is rolled up and a winding mechanism 4 for winding up the print medium after printing.

The main unit 1 includes a body 10 as a base for mounting respective mechanisms, a platen 20 for supporting a print medium M, a medium moving mechanism 30 for moving the print medium M supported by the platen 20 forward and backward, carriage 40 which is supported above the platen 20 movably rightward and leftward along the upper surface of the print medium M and holds a plurality of printer heads at predetermined gaps, a carriage moving mechanism 50 for moving the carriage rightward and leftward relative to the print medium M supported by the platen 20, and a control device 100 which includes an ejection control block for controlling ink ejection from respective nozzles of the printer heads and controls actions of respective parts of the printing apparatus P.

The body 10 includes a body frame 11 composed of a lower frame 11L in which the platen 20, feeding rollers of the medium moving mechanism 30, and the like are disposed and an upper frame 11U in which pinch rollers of the medium moving mechanism 30 and a supporting structure for the carriage 40 are disposed. Formed between the upper frame 11U and the lower frame 11L is a medium passage 15 like a horizontally long window through which the print medium M can pass and move forward and backward. The body 10 is surrounded by a front cover 13*a* covering the central portion of the body frame 11 and side covers 13*b* covering the right and left sides of the body frame 11 and is thus configured to have a shape like a horizontally long rectangular box as a whole.

The platen 20 is disposed at a central portion of the body 10 to extend over the anteroposterior length of the medium passage 15 and is provided on its upper surface with a supporting surface 21 for horizontally supporting the print medium M. The supporting surface 21 is provided with a number of suction holes formed therein. Under the supporting surface 21, a decompression chamber is disposed which can be set to have a negative pressure. By setting the decompression chamber to have a negative pressure, the print medium M is held on the supporting surface 21 by means of suction during the printing process and the cutting process. The front end and the rear end of the platen 20 extend downwards through smooth curved surfaces. At a discharge area in front of the platen 20, a heater for heating the print medium to dry ink just after printed is disposed.

The medium moving mechanism 30 includes a cylindrical feed roller 31 which is supported by the lower frame 11L positioned at a front lower portion below the medium passage 15 such that the cylindrical roller is rotatable about a rotation axis extending in the lateral direction and of which upper surface is exposed to the supporting surface 21 of the platen, a plurality of roller assemblies 35, each having rotatable pinch rollers 36 aligned in the anteroposterior direction, which are aligned at predetermined intervals in the lateral direction on the upper frame 11U above the feed roller 31, and a roller driving mechanism 32 which has an electric motor 32*m* for driving the feed rollers 31 to rotate and of which operation is controlled by the control device 100. The roller assembly 35 has a clamp position in which the pinch rollers 36 are pressed against the feed roller 31 to catch the print medium M between the upper and lower rollers 31 and 36 and an unclamp position in which the pinch rollers 36 are spaced apart upward from the feed roller 31 to allow free movement of the print medium M on the platen 20. The roller assembly 35 can be displaced between the clamp position and the unclamp position.

When the roller assembly 35 is set to the clamp position so as to press the pinch rollers 36 against the feed roller 31 from above through the print medium M on the platen, the print medium M is held in the clamped state, that is, caught between the upper and lower rollers. As the feed roller 31 is rotated by the roller driving mechanism 32 in this clamped state, the print medium M pressed against the feed roller 31 is moved in the anteroposterior direction for a feed rate corresponding to the rotating angle of the feed roller 31, that is, a feed rate according to a drive control value outputted from the control device 100 to the roller driving mechanism 32.

Attached to the upper frame 11U positioned above the medium passage 15 is a guide rail 45 extending in the lateral direction parallel to the feed roller 31. The carriage 40 having a plurality of printer heads is supported by the guide rail 45 such that the carriage 40 is movable in the lateral direction. The guide rail 45 is a supporting rail of a linear motion bearing such as a linear guide. The carriage 40 is fixed to a slide block (sometimes called ball housing or the like) fitted and supported by the guide rail 45, whereby the carriage 40 is supported above the platen 20 slidably in the lateral direction and is moved by a carriage moving mechanism 50 in the lateral direction as will be described later.

The carriage moving mechanism 50 includes a driving pulley 51 and a driven pulley 52 which are located near the opposite ends in the lateral direction of the guide rail 45, respectively, an electric motor 53 for driving the driving pulley 51 to rotate, and an endless driving belt 55 which is spanned between the driving pulley 51 and the driven pulley 52. The carriage 40 is connected and fixed to the driving belt 55. The electric motor 53 may be a servomotor or a stepping motor, the driving belt 55 may be a timing belt having a number of teeth formed in its inner periphery, the driving and driven pulleys 51, 52 may be timing belt pulleys. In this manner, the carriage 40 is adapted to be finely controlled its movement (the direction of movement, the speed of movement, the position in the lateral direction).

Figure 4:
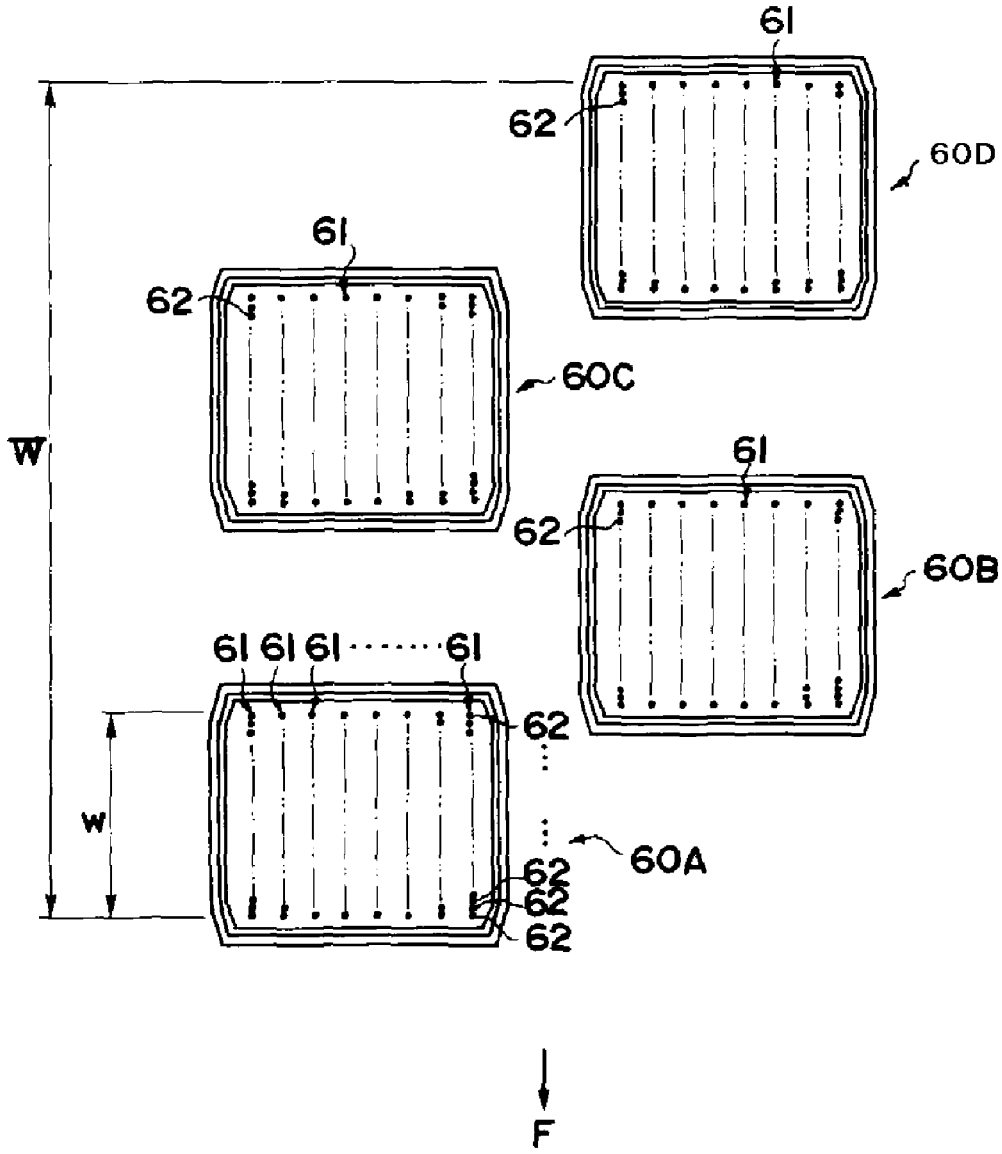
FIG. 4 is an illustration showing an arrangement of a printer head taken from the bottom side of a carriage.

In the carriage 40 which is movable in the lateral direction as mentioned above, the plurality of printer heads 60 for ejecting ink are aligned. The arrangement of the printer heads 60 as seen from the bottom of the carriage 40 is shown in FIG. 4. The printing apparatus P is configured to be a multi-head structure of a staggered arrangement in which, as shown in FIG. 4, four printer heads 60 each including a number of nozzles and capable of ejecting fine ink drops are shifted from each other in the anteroposterior direction and the lateral direction so that they are arranged in a zigzag shape.

Each printer head 60 is composed of a plurality of nozzle arrays 61 which are aligned in the lateral direction. Each nozzle array 61 is formed by a plurality of nozzles 62 for ejecting fine ink drops which are aligned linearly in the anteroposterior direction. Each nozzle array 61 is an array of nozzles which are connected to a common liquid path for supplying ink to respective nozzles 62 linearly aligned so as to eject ink of the same color. Generally, the respective nozzle arrays are set to eject ink of respective colors. The printer head 60 of this embodiment has a structure having eight nozzle arrays 61 which are aligned in the lateral direction in parallel to each other and each of which is composed of one hundred eighty nozzles 62. The printer head 60 is configured such that each two of the nozzle arrays 61 are for one of colors, i.e. black (B), cyan (C), magenta (M), and yellow (Y).

The printer heads 60, 60 . . . are disposed on the lower surface of the carriage 40 facing the supporting surface 21 of the platen such that the printer heads 60, 60 . . . are level with each other to have the same distance (gap) from the supporting surface 21 and the anteroposterior ends of the nozzle arrays of the four printer heads 60 are located continuously as seen from a lateral side of the carriage 40. The four printer heads 60, 60 . . . are marked with A, B, C, D in the order of from the front printer head for convenience of explanation. As for the printer heads 60A and 60B which are adjacent and shifted in the anteroposterior direction, the distance in the anteroposterior direction between the nozzles at the rear end position of the front-side printer head 60A and the nozzles at the front end position of the rear-side printer head 60B is set to be equal to the pitch between adjacent nozzles 62 and 62 in the same nozzle array 61.

Therefore, when ink is ejected from the printer heads 60A through 60D while moving the carriage 40 in the lateral direction relative to the print medium M held on the supporting surface 21 by means of suction, each printer head 60A, 60B, 60C, 60D forms a band-like head correspondence printing area of an anteroposterior width w of each nozzle array 61 so that the four printer heads as a whole form an integral printing area without empty space of a print width W (four times as wide as the print width w of the single printer head 60) from the nozzles at the front end position of the printer head 60A held at the front end side of the carriage 40 to the nozzles at the rear end position of the printer head 60D held at the rear end side of the carriage 40.

In each printer head 60, a common liquid path for each nozzle array 61 is connected through a tube to an ink storage portion of a cartridge type which is disposed on the body 10 side so as to supply ink to the nozzle array 60 and an actuator for ejecting ink such as a piezoelectric element disposed in a pressure chamber of each nozzle is connected to the control device 100 through a signal line, whereby the ejection of the ink from the printer head 60 is controlled.

The control device 100 is adapted to control the operations of the medium moving mechanism 30, the carriage moving mechanism 50, and the printer heads 60 according to a control program which is previously set in the printing apparatus P and a process program which is read according to an object to be processed. By introducing a print medium M to the platen 20, setting the roller assembly 35 to the clamp position, and starting the process, printing process corresponding to the process program is carried out.

Specifically, the control device 100 controls the medium moving mechanism 30 to move the print medium M to a predetermined reference position and hold the print medium M on the supporting surface 21 by means of suction and controls the respective nozzles of the four printer heads 60 to eject ink drops of color(s) and of diameter(s) according to the process program in positions in the lateral direction according to the process program while controlling the carriage moving mechanism 50 to move the carriage 40 in the lateral direction, thereby forming a laterally long band-like ink printing area of the print width W. This action is carried out in combination with and alternately with the movement in the anteroposterior direction of the print medium M by the medium moving mechanism 30, thereby producing predetermined information such as characters, figures, images according to the process program on the printing surface of the print medium M.

In the printing apparatus P having the aforementioned structure, ink drops are ejected from the respective nozzles 62, 62, . . . of the four printer heads 60A through 60D while moving the carriage 40 in the lateral direction (one way or reciprocation) so as to form an ink printing area of the print width W at once. As mentioned above, four printer heads 60 of the same specification are used as the printer heads 60A through 60D. Basically, when the printer heads 60A through 60D are actuated with control signal values for the same density (equal drop diameters), the densities of the respective head correspondence printing areas formed with ink from the printer heads are uniform, thereby achieving uniform density in the ink printing area of the print width W.

However, even after predetermined parameters (characteristic values) provided for each printer head are set, the ink ejection characteristics of the printer heads 60 may vary within a certain range because of their predetermined tolerance. In addition, the ink ejection characteristics may vary slightly due to temperature distribution in the carriage to which the printer heads are mounted, differences in flow resistance in a piping system for supplying ink to the printer heads, and differences in electrical characteristics in a signal transmitting system for transmitting driving signals to the ejection actuators of the printer heads. According to the combination among the printer heads 60A through 60D to be mounted in the carriage 40, the density of the head correspondence printing area printed by any printer head may be lower (or higher) than that of the other head correspondence printing areas, thus producing a strap like contrasting density (banding) in the ink printing area of the print width W.

For this, the printing apparatus P has an inter-head ejection characteristic adjusting function for compensating differences in the ejection characteristics among the printer heads in order to finally achieve uniform density of the head correspondence printing areas, that is, to prevent banding even when there is variation in characteristics of the printer heads 60A through 60D. Specifically, the control device 100 is adapted to control the actions of the respective parts.

FIG. 1 is a block diagram showing the control structure for achieving the inter-head ejection characteristic adjusting function. The control structure includes mainly a printing detecting unit 80 for detecting printing states of ink deposited on the print medium M, a movement control block 110 disposed in the control device 100 for controlling the drive of the medium moving mechanism and the carriage moving mechanism and an ejection control block 120 disposed in the control device 100 for controlling the ejection of ink from the respective printer heads, the carriage moving mechanism 50 for moving the carriage 40 based on command signal outputted from the control device 100, and the printer heads 60A through 60D.

The ejection control block 120 in the control device includes a calculation section 121, a comparing section 122 for comparing the printing states detected by the printing detecting unit 80, a compensating section 123 for compensating the ejection control values for the respective printer heads, and an actuator driving section 125 for outputting driving signals to the actuators of the respective printer heads.

The printing detecting unit 80 is a unit for detecting the printing states of ink deposited on the print medium M and includes an observation optical system 81 for observing the printing area of ink, and a photographing optical system 82 for taking an image of the printing area observed by the observation optical system 81. The observation optical system 81 may be, for example, a lens system for optically magnifying the ink printing area by ten times through twenty times. The photographing optical system 82 may be a color or monochrome CCD camera. Image of the ink printing area taken by the photographing optical system is converted into an image signal. The image signal is outputted from the printing detecting unit 80 and inputted into the control device 100.

The printing detecting unit 80 is supported by the guide rail 45 so that the printing detecting unit 80 can slide in the lateral direction above the print medium M and is adapted to be engaged with a hook receiving portion of a holding station disposed on a left side outside of the printing area and with a hook receiving portion disposed on a left wall of the carriage 40 by a coupling mechanism 85 of swinging hook form disposed in the printing detecting unit 80. Accordingly, the carriage 40 is moved by the carriage moving mechanism 50 to a position in the vicinity of the left end of the guide rail 45, the printing detecting unit 80 is then coupled with the carriage 40 by the coupling mechanism 85, and the coupling between the holding station and the printing detecting unit 80 is cancelled. By moving the carriage 40 in this state to the right, the printing detecting unit 80 is moved to any place in the lateral direction on the print medium M so as to observe the print medium M. The printing detecting unit 80 is also adapted to hold the observation optical system 81 and the photographing optical system 82 such that they are movable in the anteroposterior direction relative to the print medium M. By moving the viewing area of the observation optical system 81 in the anteroposterior direction, the printing detecting unit 80 can observe the head correspondence printing areas formed by the respective printer heads 60A through 60D.

The ejection control block 120 conducts a control of outputting ejection control signals of ejection control values according to the process program to the respective actuators provided corresponding to the respective nozzles 62, 62 . . . of the printer heads 60A through 60D according to the process program read by the control device 100 so as to eject ink drops of a diameter corresponding to the ejection control value at a predetermined position in the lateral direction of the print medium M. That is, the density of information such as an image to be printed on the print medium M by the printing apparatus P is defined by the drop diameter of the ink drops ejected from the respective nozzles 62 to deposit on the print medium M and the distribution density in the lateral direction.

Figure 5:
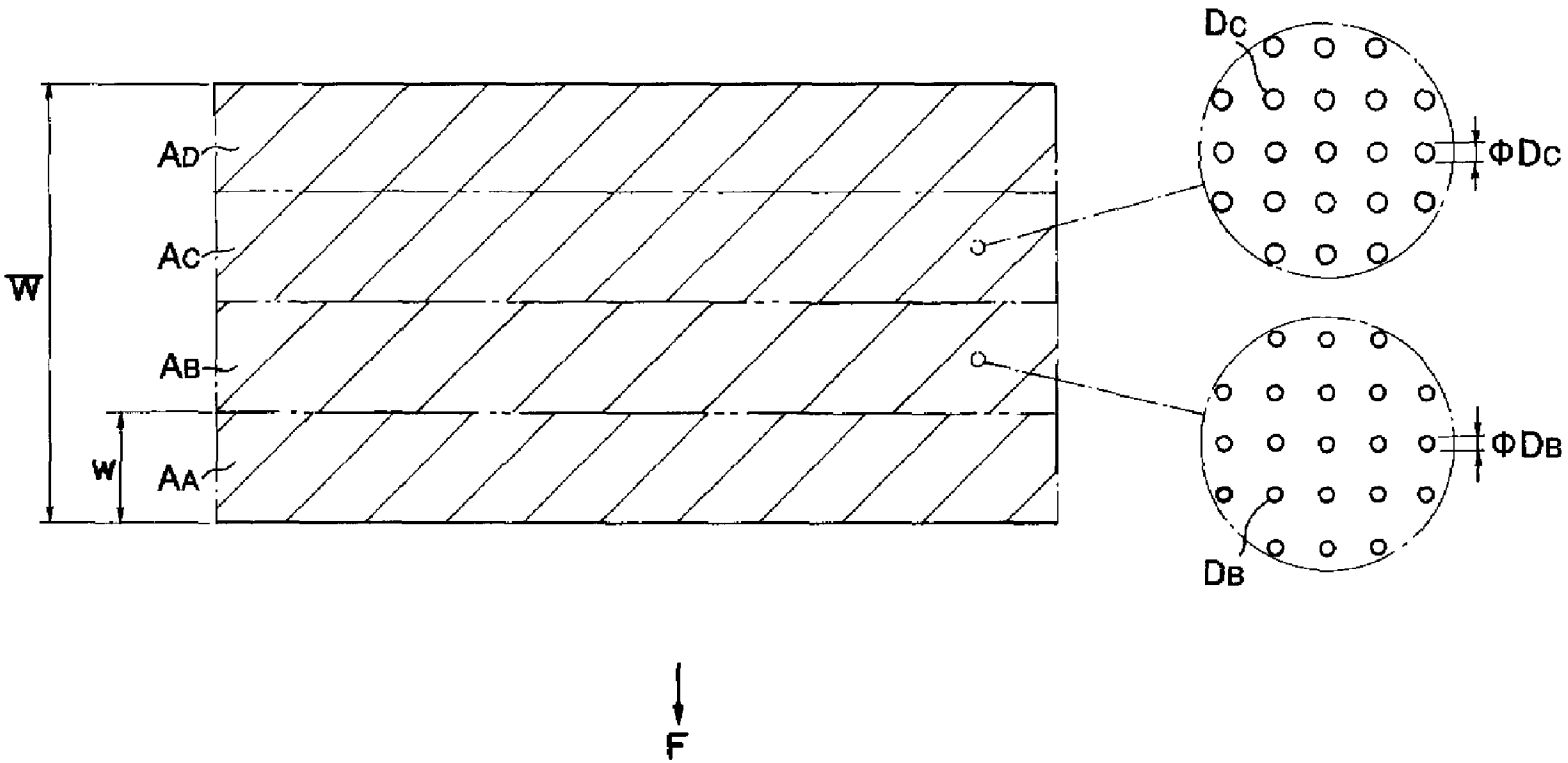
FIG. 5 is a schematic explanatory illustration showing an image detected by a printing detecting unit.

FIG. 5 is a schematic illustration showing a state that the density of a head correspondence printing area $A_B$, as the second raw from the front F (the lower side in FIG. 5), formed by the printer head 60B is lower than the density of the head correspondence printing areas $A_A$, $A_C$, $A_D$ formed by the other printer heads 60A, 60B, 60C even when the printer heads 60A through 60D are controlled to eject ink with ejection control values of the same density to form an ink printing area of the print width W. Enlarged images of the head correspondence printing areas $A_B$ and $A_C$ detected by the printing detecting unit 80 are schematically shown in circles. As shown in this drawing, when ink is ejected with the ejection control values of the same density, the distribution densities of ink dots $D_B$, $D_C$ formed on the print medium M by deposition of ink drops are uniform, but the diameters (called "spot diameters") $\phi D_B$, $\phi D_C$ of dots make differences in density between the head correspondence printing areas $A_B$: $A_C$.

The calculation section 121 of the ejection control block 120 calculates the printing states of ink deposited on the print medium M from image signals, as shown in FIG. 5, inputted from the printing detecting unit 80. The printing states of ink, that is, the geometric distribution state of ink deposited on the print medium M can be evaluated by various evaluation methods according to, for example, the spot diameters or areas of deposited ink drops, the density per area of ink, and the lightness of an area to be observed. The following description will be made with regard to a case using the spot diameters, that is, diameters of ink dots deposited and formed on the print medium, as the printing states of ink. The calculation section 121 calculates the spot diameters $\phi D_A$ through $\phi D_D$ of ink in the respective head correspondence printing areas $A_A$ through $A_D$ based on image signals inputted from the printing detecting unit 80. In this case, the spot diameter for each head correspondence printing area is obtained by calculating spot diameters of a plurality of dots and averaging the calculated spot diameters.

The comparing section 122 compares the spot diameters $\phi D_A$ through $\phi D_D$ of the respective head correspondence printing areas obtained by the calculation section 121. The comparing method may be a known method, for example, difference ($\phi D_B - \phi D$), percentage ($\phi D_B / \phi D$), or ratio ($(\phi D_B - \phi D)/\phi D$) of the spot diameter of each head correspondence printing area relative to the average $\phi D$ of the spot diameters $\phi D_A$ through $\phi D_D$.

The compensating section 123 sets a compensation value to the ejection control value based on the aforementioned comparison result. In this embodiment, employed as the compensation value is a temperature compensation value which is previously set to cope with variation in ink drop diameter according to the variation in ambient temperature. The temperature compensation value is a compensation value for increasing or decreasing the amplitude of ejection control signal to be outputted to the actuators of the nozzles within a certain range. For example, since the higher the ambient temperature is, the lower the dynamic coefficient of viscosity of the ink is (the easier the ink flows), the diameter of ink drops ejected from the nozzles is increased. Therefore, a compensation value for decreasing the amplitude of ejection control signal is previously set and stored as a temperature compensation value for higher temperature. On the other hand, since the lower the ambient temperature is, the higher the dynamic coefficient of viscosity of the ink is (the harder the ink flows), the diameter of ink drops ejected from the nozzles is decreased. Therefore, a compensation value for increasing the amplitude of ejection control signal is previously set and stored as a temperature compensation value for lower temperature.

The actuator driving section 125 outputs an ejection control signal of an amplitude corresponding to the ejection control value of the process program to the actuators disposed to pressure chambers (generally, piezoelectric elements PZT are used) corresponding to the nozzles 62, 62 . . . of the printer heads 60A through 60D so as to eject ink drops of diameters according to the ejection control signals from the respective nozzles 62, 62 . . . to the print medium M. When there is a temperature compensation value set to one or more of the printer heads, the actuator driving section 125 outputs an ejection control signal to which the temperature compensation value is applied to the ejection control value to the actuators of the respective nozzles of the appropriate printer head (s).

Figure 6A:
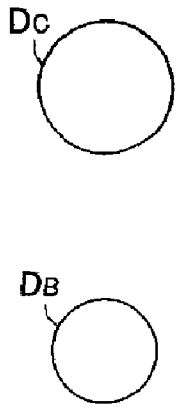
FIGS. 6A-6C are explanatory illustrations (1) showing aspects of the spot diameter which varies according to the setting of the temperature compensation value.
Figure 6B:
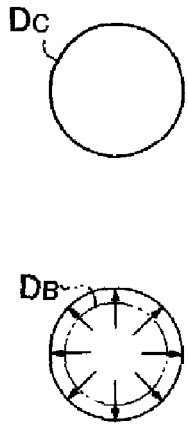
Figure 6C:
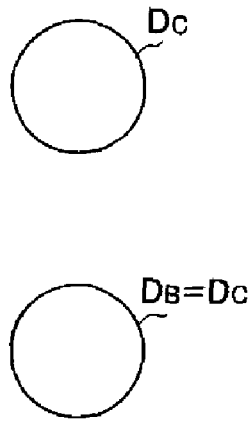

FIGS. 6(*a*)-6(*c*) are explanatory illustrations showing aspects of the spot diameter which varies according to the setting of the temperature compensation value. Illustrated in the upper side of this drawing are dots $D_C$ of the head correspondence printing area $A_C$ formed by the printer head 60C shown in FIG. 5 and illustrated in the lower side are dots $D_B$ of the head correspondence printing area $A_B$ formed by the printer head 60B. In the drawings (a) through (c), (a) shows a state before setting a compensation value, (b) shows direction of the compensation, and (c) shows a state after setting the compensation value.

When the spot diameter $\phi D_B$ of the head correspondence printing area $A_B$ is smaller than the spot diameter of the other head correspondence printing areas within the predetermined range, the compensating section 123 selects a temperature compensation value only for the printer head 60B according to the result (difference, percentage, ratio or the like) of the comparison by the comparing section 122 to set the temperature compensation value to the ejection control value to the printer head 60B. The actuator driving section 125 outputs an ejection control signal, in which the temperature compensation value is adapted to the ejection control value, to the actuators of the respective nozzles of the printer head 60B. That is, to increase the diameter of ink dots ejected from the printer head 60B to the diameter of ink dots ejected from the other printer heads as shown in FIG. 6(*b*), a temperature compensation value for lower temperature according to the comparison result is set. Accordingly, the diameter of ink dots ejected from the printer head 60B is increased so that the spot diameter of the dots $D_B$ by the printer head 60B is set to be equal to the spot diameter by the other printer heads 60A, 60C, 60D as shown in FIG. 6(*c*).

Figure 7A:
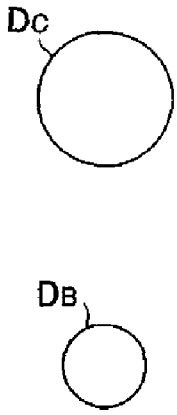
FIGS. 7A-7C are explanatory illustrations (2) showing aspects of the spot diameters which vary according to the setting of the temperature compensation value.
Figure 7B:
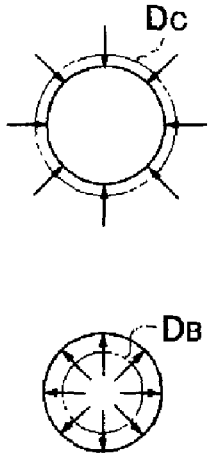
Figure 7C:
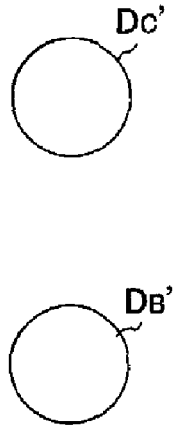

FIGS. 7(*a*)-7(*c*) are explanatory illustrations showing aspects of the spot diameter which varies according to the setting of the temperature compensation value similar to FIGS. 6(*a*)-6(*c*). In this case, however, the difference between the spot diameter $\phi D_B$ of dots $D_B$ by the printer head 60B and the spot diameter $\phi D_C$ of dots $D_C$ by the printer head 60C is large. When the difference between the spot diameters exceeds the predetermined adjustable range as only for the printer head 60B like this case, the compensating section 123 sets temperature compensation values not only for the printer head 60B but also for the other printer heads 60A, 60C, 60D according to the result (difference, percentage, ratio or the like) of the comparison by the comparing section 122 to set the temperature compensation values to the ejection control values to the respective printer heads.

That is, as shown in FIG. 7(*b*), a temperature compensation value for lower temperature is set to increase the diameter of ink dots ejected from the printer head 60B and a temperature compensation value for higher temperature is set to decrease the diameter of ink dots ejected from the other printer heads. Accordingly, the diameter of ink dots ejected from the printer head 60B is increased while the diameter of ink dots ejected from the other printer heads is decreased so that the spot diameters of the dots by all of the printer heads are set to be equal to each other as shown in FIG. 7(*c*).

Hereinafter, in the printing apparatus P having the aforementioned structure, the action by the control device 100 for conducting the inter-head ejection characteristic adjusting function will be described. The inter-head ejection characteristic adjusting function is set and stored in the control device 100 as an inter-head ejection characteristic adjusting program for carrying out this function.

As an operator selects and starts the inter-head ejection characteristic adjusting program, the control device 100 carries out test printing for forming four head correspondence printing areas corresponding to the printer heads 60A, 60B, 60C, 60D, respectively, to the print medium M. That is, the control device 100 outputs a driving control signal from the movement control block 110 to the medium moving mechanism 30 to move the print medium M to a predetermined reference position and hold the print medium M on the supporting surface 21 by means of suction, and output ejection control signals of an ejection control value for the same density from the ejection control block 120 to the printer heads 60A through 60D to eject ink from the nozzles 62, 62 . . . of the respective printer heads while moving the carriage 40 in the lateral direction by the carriage moving mechanism 50, thereby forming an ink printing area of the print width W composed of four head correspondence printing areas.

Then, the control device 100 moves the carriage 40 to the left by the carriage moving mechanism 50 to couple the carriage 40 with the printing detecting unit 80, which has been held by the holding station, by the coupling mechanism 85, and then moves the carriage 40 to the right to move the printing detecting unit 80 to a predetermined position in the lateral direction, for example, a middle position of the print medium M. Then, the control device 100 moves the observation optical system 81 and the photographing optical system 82 of the printing detecting unit 80 in the anteroposterior direction and controls the photographing optical system 82 to sequentially take enlarged images of the head correspondence printing areas $A_A$ through $A_D$ produced by the printer heads 60A through 60D.

Image signals of images taken by the photographing optical system 82 are inputted into the calculating section 121 of the ejection control block 120. The calculating section 121 processes the image signals inputted from the printing detecting unit 80 to calculate the spot diameters $D_A$ through $D_D$ of ink in the respective head correspondence printing areas $A_A$ through $A_D$. The spot diameters $D_A$ through $D_D$ calculated are compared by the comparing section 122. Then, based on the comparison results, the compensating section 123 sets and stores temperature comparison values according to the comparison results as shown in FIG. 6 and FIG. 7. In printing after this process, therefore, an ejection control signal in which a temperature compensation value is added to the ejection control value of each printer head according to the process program is outputted from the actuator driving section 125 to the appropriate printer head (60B), thereby controlling the spot diameters of the printer heads 60A through 60D to be equal in relation to the ejection control value for the uniform density. In case of the ejection signal value for the uniform density on the process program, the spot diameters $\phi D_A$ through $\phi D_D$ and the distribution densities of ink in the head correspondence printing areas $A_A$ through $A_D$ formed by the respective printer heads are uniform so as to make the density of the respective head correspondence printing areas uniform, thereby enabling the entire print width W to be printed with uniform density.

As the setting of the compensation value(s) is terminated, the control device 100 displays a message on the display panel of the control device 100 to ask the operator whether or not to start a test print for confirmation and waits for an answer. If there is a command to start the test print, the control device 100 outputs a driving control signal to the medium moving mechanism 30 to move the print medium for a predetermined amount forward and then conducts the test print again with the ejection control signals plus the temperature compensation value(s). If it is confirmed by this print test that the entire print width W is printed with uniform density and a termination button is operated, the control device 100 outputs a driving control signal from the movement control block 110 to the carriage driving mechanism 50 to move the carriage 40 to the holding station at which the printing detecting unit 80 is engaged with the holding station by the coupling mechanism 85 and the engagement between the carriage 40 and the printing detecting unit 80 is canceled. Then, the carriage 40 is moved to a predetermined waiting position, for example, a waiting station on the right side of the medium passage 15 and is stopped in the waiting state. Thus, the inter-head ejection characteristic adjusting program is terminated.

The optimization of temperature compensation value(s) may be conducted by detecting spot diameters at a plurality of position on both right and left sides for the ink printing area of the print width W and comparing the spot diameters detected. The test print may be conducted by forming a plurality of rows of ink printing areas with different brightness and different chromaticness and averaging the respective temperature compensation values for the brightness and chromaticness obtained by the test print, and may be conducted using different temperature compensation values for every ink rows which have different colors.

According to the control device 100 and the control method for inter-head ejection characteristic adjustment as mentioned above, in an inkjet printer having a plurality of printer heads, even when there is a variation in ejection characteristics among the printer heads, a suitable compensation value is automatically set for an appropriate printer head as an object to be compensated, thereby ensuring printing with uniform density over entire print width W without complex operation such as replacing the printer head. Since existing temperature compensation values are used as the compensation values, a simple and reasonable arrangement for preventing the banding is achieved. As a means for judging the printing states of ink in the respective head correspondence printing areas, an arrangement of detecting spot diameters of ink deposited on a print medium M is used, thereby achieving steady compensation with a relatively simple control system.

Though the aforementioned embodiment has been described with reference to a case in which the deposition diameter (spot diameter) of ink deposited on the print medium M is used as "printing state" for convenience of explanation, there are various indexical properties for evaluating the printing state of ink as mentioned above so that the other indexical properties may be used similarly to provide effects peculiar to the respective indexical properties. For example, according to a case that the deposited area or the area density (the area of ink occupying a unit area of a print medium) of ink deposited on the print medium M is used as the indexical property for evaluating the ink printing state, accurate detection and comparison can be conducted so as to enable setting of a suitable temperature compensation value even when there are ink dots of which shapes are deformed circles (making its diameter hard to calculate (easily making large error in calculation) such as a gourd-like shape and a meteoric shape).

Though an aspect using the temperature compensation values as the compensation values for compensating the ejection control value has been illustrated, such an aspect that the compensating section 123 calculates a compensation value based on the comparison result by the comparing section 122 and the ejection control signal is changed by using the compensation value may be employed. Alternatively, such an aspect that a control of increasing or cooling down the temperature of the appropriate printer head or the temperature of ink to be supplied to the appropriate printer head for a temperature corresponding to the temperature compensation value is conducted may be employed.

Though the aforementioned embodiment has been described with reference to a printing apparatus of a type having X-Y axes, i.e. two axes one of which is for movement of a print medium and the other one of which is for movement of a printer head, the present invention may be adapted to an inkjet printer of another type, for example, a printing apparatus of a table moving type in which a print medium is fixed and held on a table and the table is moved and a printing apparatus of a head moving type in which a X-axis carriage and a Y-axis carriage are moved in both X-Y directions relative to a table holding a print medium.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An inkjet printer comprising: a first printer head having a plurality of first nozzles and configured to eject ink from the plurality of first nozzles to a first printing area on a surface of a print medium to form first ink dots in the first printing area, the first printer head being configured to eject ink of a plurality of different colors to the first printing area; a second printer head having a plurality of second nozzles and configured to eject ink from the plurality of second nozzles to a second printing area on the surface of the print medium to form second ink dots in the second printing area, the second printer head being configured to eject ink of a plurality of different colors to the second printing area; a carriage holding the first and second printer heads and relatively movable along first and second directions with respect to the surface of the print medium, the first and second directions being perpendicular; a detector configured to detect first and second printing states in the first and second printing areas, respectively; a comparing unit configured to compare the first and second printing states detected by the detector; an ejection controller configured to control ejection from the first and second printer heads; a temperature compensator configured to compensate the ejection control performed by the ejection controller according to a temperature compensation value to make diameters of ink ejected from the first and second printer heads be substantially constant even though an ambient temperature changes, the temperature compensation value being determined corresponding to the ambient temperature, and being predetermined based on a relation between the ambient temperature and a diameter of ink drop at the ambient temperature; and a printing state compensator configured to compensate ejection control performed by the ejection controller according to a compensation value produced based on a comparison result output by the comparing unit so that the first and second printing states are substantially equal, wherein the plurality of first nozzles are provided in a first nozzle array and the plurality of second nozzles are provided in a second nozzle array, and wherein the first nozzle array is identical in configuration to the second nozzle array, and wherein the printing state compensator is configured to use an adjusted temperature compensation value as the compensation value for the ejection control of at least one of the first and the second printer heads, the adjusted temperature compensation value being a temperature compensation value corresponding to a temperature which is adjusted from the ambient temperature based on the comparison result output by the comparing unit.

2. The inkjet printer according to claim 1, wherein the inkjet printer comprises, a first driver configured to move the print medium in the first direction, and a second driver configured to move the carriage in the second direction.

3. The inkjet printer according to claim 2, wherein the first and second printer heads are arranged along the first direction.

4. The inkjet printer according to claim 2, wherein the first and second printing areas are located next to each other along the first direction.

5. The inkjet printer according to claim 1, wherein the first printing state is represented by a diameter of at least one of the first ink dots, and wherein the second printing state is represented by a diameter of at least one of the second ink dots.

6. The inkjet printer according to claim 1, wherein the first printing state is represented by a first area density of the first ink dots, and wherein the second printing state is represented by a second area density of the second ink dots.

7. The inkjet printer according to claim 1, wherein the detector comprises a camera.

8. The inkjet printer according to claim 1, wherein the printing state compensator is configured to control the temperature compensator to compensate the ejection control performed by the ejection controller according to the comparison result output by the comparing unit so that the first and second printing states are substantially equal.

9. An inkjet printer comprising: first ejection means for ejecting ink to a first printing area on a surface of a print medium to form first ink dots in the first printing area, the first ejection means being configured to eject ink of a plurality of different colors to the first printing area, wherein the first ejection means has a plurality of first nozzles; second ejection means for ejecting ink to a second printing area on the surface of the print medium to form second ink dots in the second printing area, the second ejection means being configured to eject ink of a plurality of different colors to the second printing area, wherein the second ejection means has a plurality of second nozzles; a carriage holding the first and second ejection means and relatively movable along first and second directions with respect to the surface of the print medium, the first and second directions being perpendicular; detecting means for detecting first and second printing states in the first and second printing areas, respectively; comparing means for comparing the first and second printing states detected by the detecting means; ejection controlling means for controlling ejection from the first and second ejection means; a temperature compensating means for compensating the ejection control performed by the ejection controlling means according to a temperature compensation value to make diameters of ink ejected from the first and second ejection means be substantially constant even though an ambient temperature changes, the temperature compensation value being determined corresponding to the ambient temperature, and being predetermined based on a relation between the ambient temperature and a diameter of ink drop at the ambient temperature; and printing state compensation means for compensating ejection control performed by the ejection controlling means according to a compensation value produced based on a comparison result output by the comparing means so that the first and second printing states are substantially equal, wherein the plurality of first nozzles are provided in a first nozzle array and the plurality of second nozzles are provided in a second nozzle array, and wherein the first nozzle array is identical in configuration to the second nozzle array, and wherein the printing state compensating means is configured to use an adjusted temperature compensation value as the compensation value for the ejection control of at least one of the first and the second ejection means, the adjusted temperature compensation value being a temperature compensation value corresponding to a temperature which is adjusted from the ambient temperature based on the comparison result output by the comparing means.

10. An inkjet printer controller comprising: a detector configured to detect first and second printing states in first and second printing areas, respectively, a first printer head ejecting ink of a plurality of different colors to the first printing area on a surface of a print medium, a second printer head ejecting ink of a plurality of different colors to the second printing area on the surface of the print medium; a comparing unit configured to compare the first and second printing states detected by the detector; an ejection controller configured to control ejection from the first and second printer heads; a temperature compensator configured to compensate the ejection control performed by the ejection controller according to a temperature compensation value to make diameters of ink ejected from the first and second printer heads be substantially constant even though an ambient temperature changes, the temperature compensation value being determined corresponding to the ambient temperature, and being predetermined based on a relation between the ambient temperature and a diameter of ink drop at the ambient temperature; and a printing state compensator configured to compensate ejection control performed by the ejection controller according to a compensation value produced based on a comparison result output by the comparing unit so that the first and second printing states are substantially equal, wherein a plurality of first nozzles are provided in a first nozzle array and a plurality of second nozzles are provided in a second nozzle array, and wherein the first nozzle array is identical in configuration to the second nozzle array, and wherein the printing state compensator is configured to use an adjusted temperature compensation value as the compensation value for the ejection control of at least one of the first and the second printer heads, the adjusted temperature compensation value being a temperature compensation value corresponding to a temperature which is adjusted from the ambient temperature based on the comparison result output by the comparing unit.

11. A method for controlling an inkjet printer, comprising: ejecting ink from a first printer head to a first printing area on a surface of a print medium, the first printer head being configured to eject ink of a plurality of different colors to the first printing area; ejecting ink from a second printer head to a second printing area on the surface of the print medium, the second printer head being configured to eject ink of a plurality of different colors to the second printing area; detecting first and second printing states in the first and second printing areas, respectively; comparing the first and second printing states; controlling ejection from the first and second printer heads; compensating ejection control according to a temperature compensation value to make diameters of ink ejected from the first and second printer heads be substantially constant even though an ambient temperature changes, the temperature compensation value being determined corresponding to the ambient temperature, and being predetermined based on a relation between the ambient temperature and a diameter of ink drop at the ambient temperature; and compensating ejection control in the controlling step according to a compensation value produced based on a comparison result in the comparing step so that the first and second printing states are substantially equal, wherein a plurality of first nozzles are provided in a first nozzle array and a plurality of second nozzles are provided in a second nozzle array, and wherein the first nozzle array is identical in configuration to the second nozzle array, and wherein an adjusted temperature compensation value is used as the compensation value for the ejection control of at least one of the first and the second printer heads, the adjusted temperature compensation value being a temperature compensation value corresponding to a temperature which is adjusted from the ambient temperature based on the comparison result in the comparing step.

12. The inkjet printer according to claim 1, further comprising a third printer head having a plurality of third nozzles and configured to eject ink from the plurality of third nozzles to a third printing area on the surface of the print medium to form third ink dots in the third printing area, the third printer head being configured to eject ink of a plurality of different colors to the third printing area, wherein the plurality of third nozzles are provided in a same nozzle array as the plurality of first nozzles.

13. The inkjet printer according to claim 12, wherein the carriage is configured to hold the first printer head, the second printer head, and the third printer head in a zigzag configuration extending along a feed direction of the print medium.

14. The inkjet printer according to claim 9, further comprising a third ejection means for ejecting ink to a third printing area on the surface of the print medium to form third ink dots in the third printing area, the third ejection means being configured to eject ink of a plurality of different colors to the third printing area, wherein the third ejection means has a plurality of third nozzles that are provided in a same nozzle array as the plurality of first nozzles of the first ejection means.

15. The inkjet printer according to claim 14, wherein the carriage is configured to hold the first ejection means, the second ejection means, and the third ejection means in a zigzag configuration extending along a feed direction of the print medium.

16. The inkjet printer controller according to claim 10, wherein the detector is further configured to detect a third printing state in a third printing, a third printer head ejecting ink of a plurality of different colors to a third printing area on the surface of the print medium, wherein a plurality of third nozzles are provided in a same nozzle array as the plurality of first nozzles.

17. The inkjet printer controller according to claim 16, wherein the first printer head, the second printer head, and the third printer head are provided on a carriage in a zigzag configuration extending along a feed direction of the print medium.

18. The method according to claim 11, further comprising ejecting ink from a third printer head to a third printing area on the surface of the print medium, the third printer head being configured to eject ink of a plurality of different colors to the third printing area, wherein a plurality of third nozzles are provided in a same nozzle array as the plurality of first nozzles.

19. The method according to claim 18, wherein the first printer head, the second printer head, and the third printer head are provided on a carriage in a zigzag configuration extending along a feed direction of the print medium.

* * * * *